US005516320A

United States Patent [19]

LaPlant

[11] Patent Number: 5,516,320

[45] Date of Patent: May 14, 1996

[54] RECREATIONAL FLOATATION DEVICE

[76] Inventor: Rosalie O. LaPlant, 301 North St., East Prairie, Mo. 63845

[21] Appl. No.: 358,261

[22] Filed: Dec. 19, 1994

[51] Int. Cl.[6] ..... B63C 9/08

[52] U.S. Cl. ..... 441/106; 441/113

[58] Field of Search ..... D21/237, 238; 441/88, 106, 108, 113, 114, 115, 120, 129; 2/67

[56] References Cited

U.S. PATENT DOCUMENTS

| | | | |
|---|---|---|---|
| D. 280,005 | 8/1985 | Jones | D21/238 |
| D. 310,700 | 9/1990 | Jones | D21/238 |
| 1,932,708 | 10/1933 | Phillips, Jr. | 441/113 |
| 2,775,776 | 1/1957 | Shaw | 9/20 |
| 3,935,608 | 2/1976 | Freedman et al. | 9/391 |
| 4,291,427 | 9/1981 | Rhea | 9/329 |
| 4,986,786 | 1/1991 | Helt et al. | 441/120 |
| 5,092,802 | 3/1992 | Jones | 441/88 |

*Primary Examiner*—Edwin L. Swinehart
*Attorney, Agent, or Firm*—Grace J. Fishel

[57] ABSTRACT

A recreational floatation device rising to about the wearer's diaphragm fits over the wearer's stomach, buttocks and hips and about his or her waist and the tops of his or her legs. The device has front and rear sections carrying a substantially uniform layer of floatation material in an amount sufficient to float the wearer at about mid-chest height, a pad of floatation material extending from the wearer's waist through the crotch in both the front and rear sections.

5 Claims, 2 Drawing Sheets

RECREATIONAL FLOATATION DEVICE

BACKGROUND OF THE INVENTION

1. Field of the Invention

The present invention relates to a recreational floatation device to be worn on the lower torso over a bathing suit.

2. Brief Description of the Prior Art

Many people have discovered, or rediscovered, swimming after years of pounding their joints playing tennis, jogging or doing aerobics. Health clubs now offer a wide and growing variety of water exercise classes including deep-water running, water aerobics, water step, water jogging and water weights. In addition to physical benefits, swimming also has psychological benefits that go beyond feeling virtuous, with some swimmers experiencing a relaxed, meditative state. Sometimes people like to sit in the water without swimming, to talk, to play water sports, etc., while others are there to supervise their children.

Many people are not good swimmers, either because they never learned or because of infirmity resulting from disease or advancing age, and lacking confidence in the water, may be left out or pass up recreational opportunities. There are other obstacles too. Women, especially, do not like having to dry their hair and reapply makeup.

An ideal recreational floatation device for a less-confident swimmer or for a swimmer who does not want to get his or her hair wet would float a person head up, feet down, at mid-chest height, most people feeling comfortable in water at that level. The same floatation device would be useful to a swimmer who wants to sit in the water with his hands free to relax, to play water sports, etc.

There are swim suits padded with buoyancy material for the weak swimmer but they make the wearer look fat, make it difficult to bend over and are hot out of the water and, in addition, do not keep the wearer's hair dry. U.S. Pat. No. 4,986,786 to Helt et al. describes a garment, shaped like a diaper and taped at the waist with VELCRO® hook and loop fasteners, to be worn over a swimming suit. The garment covers the wearer's stomach and buttocks but does not cover or grip his or her hips nor does it encircle the tops of his or her legs.

There are also floatation devices of the kind intended to be worn by the user (e.g., life vests) and of the kind intended to be grasped by the user (e.g., rings and buoyant cushions). These devices are designed to float a person face up with the balance of his body in the water and while useful as a safety provision against a chance that a person may be suddenly thrown into the water are not adapted to use by a swimmer to supplement his or her swimming skills.

SUMMARY OF THE INVENTION

In view of the above, it is an object of the present invention to provide a recreational floatation device that is ideally suited to the needs of a swimmer who wants to relax or play in the water with his or her hands free or to the needs of a weak swimmer or a swimmer who merely does not want to get his or her head wet. It is also an object to provide a recreational floatation device that will float a wearer head up, feet down, at mid-chest height. It is also an object to provide a recreational floatation device to be worn over a bathing suit. Other objects and features of the invention will be in part apparent and in part pointed out hereinafter.

In accordance with the invention, a recreational floatation device for wear by a person on his or her lower torso over a swimming suit fits over the wearer's stomach, buttocks and hips and fits relatively snugly around his or her hips and around the tops of his or her legs. The device has front and rear sections, each section having a top, bottom and side edges. The top edge rises to about the level of the wearer's diaphragm and the sections are joined along the side edges, at least one of which side edges being releasable to allow the wearer to put on and take off the device. The sections also narrow along the bottom edge and are joined to form a crotch with the front and rear sections carrying a substantially uniform layer of floatation material in an amount sufficient to float the wearer at about mid-chest height in deep water.

The invention summarized above comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
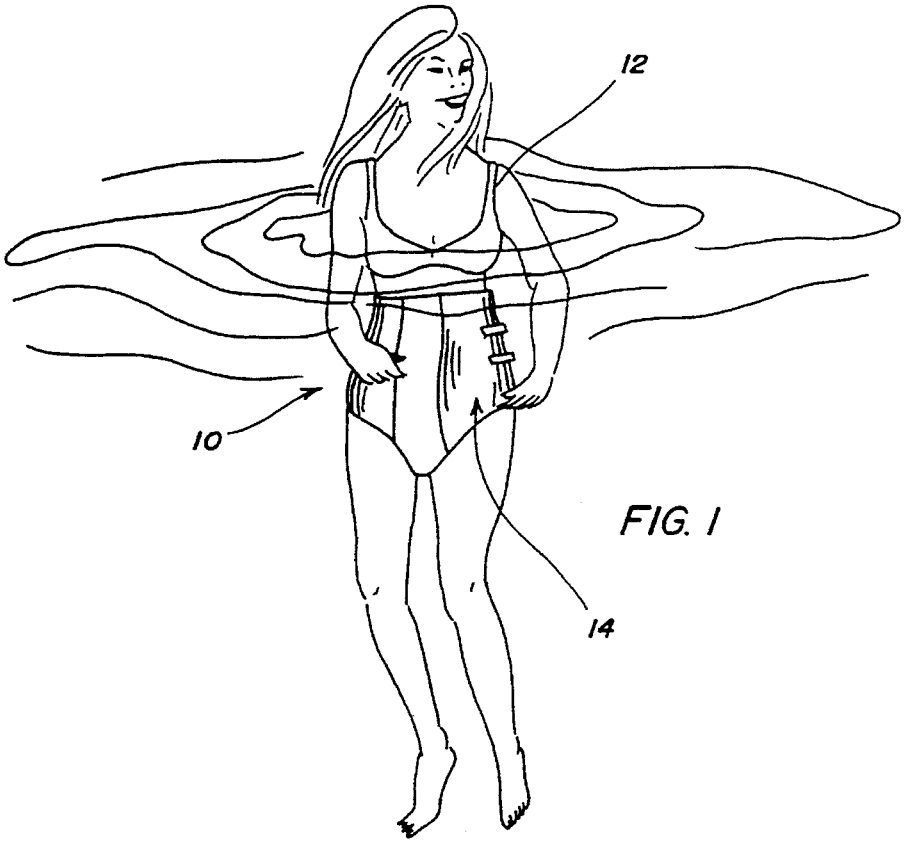
FIG. 1 is a view of a person wearing a recreational floatation device in accordance with the present invention.
Figure 2:
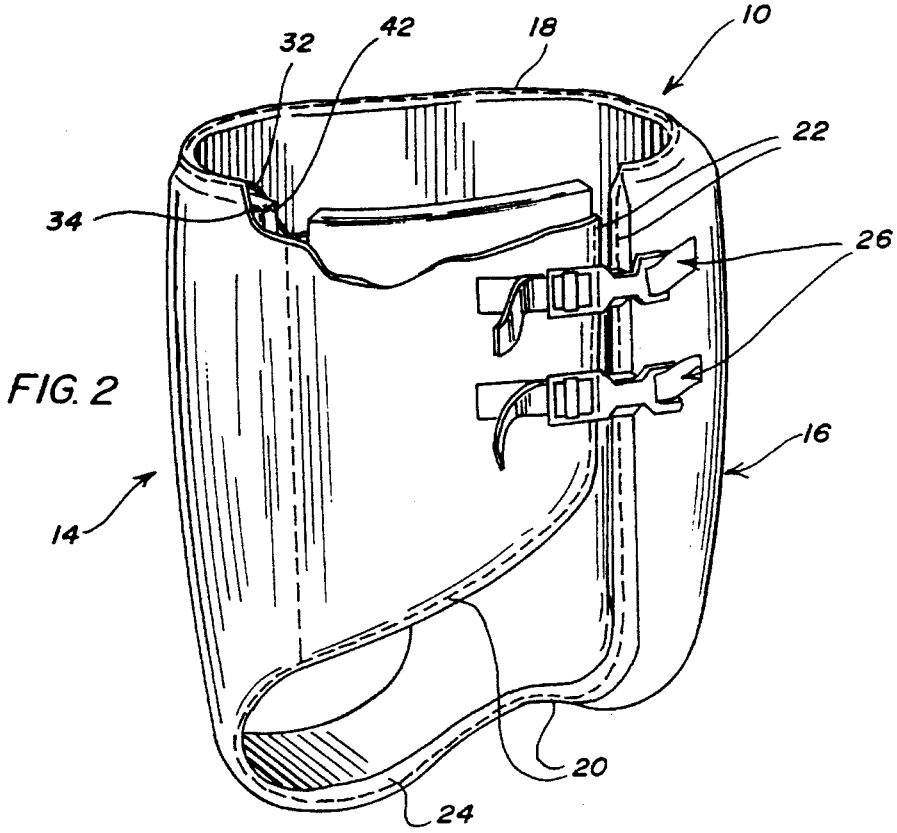
FIG. 2 is a perspective view of the device with a side opening closed with a pair of side release buckles.
Figure 3:
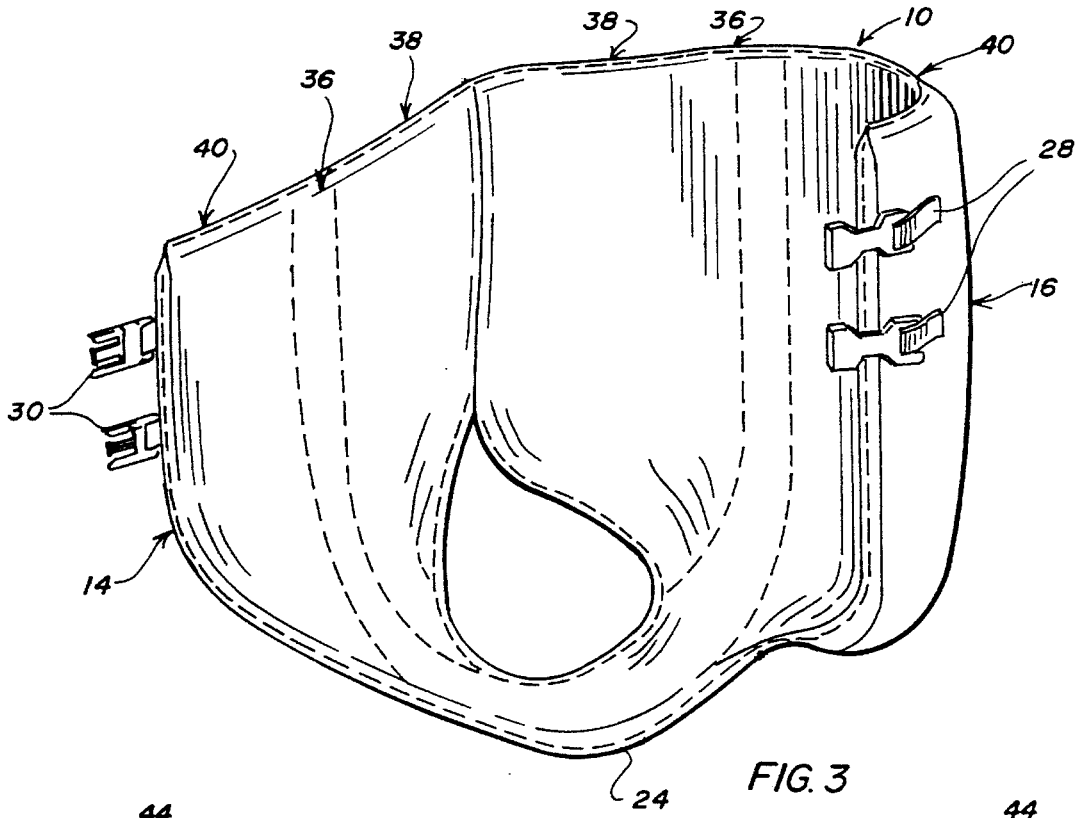
FIG. 3 is a perspective view of the device with the buckles open.

Referring to the drawings more particularly by reference character, reference numeral 10 refers to a recreational floatation device in accordance with the present invention. As shown in the drawings, device 10 is for outerwear over a swimming suit 12 and rises above a wearer's waist to about diaphragm height, covering the stomach, buttocks and hips of the wearer and fitting relatively snugly around his or her hips and around the tops of his or her legs. Device 10 has front and rear sections 14, 16, respectively, with top, bottom and side edges 18, 20, 22, respectively, said sections narrowing along the bottom edge to form a crotch 24.

Corresponding side edges 22 of front and rear sections 14, 16 are joined, one of which joined side edges being releasable to allow the wearer to put on and take off the device and the other of which may be fixedly closed. As shown in the drawings, the releasable side edges are closed with a pair of side release buckles 26 of the kind having a cooperating receptacle member 28 and a clasp member 30 both preferably molded from a tough resilient plastic material.

Front and rear sections 14, 16 carry floatation material in an amount sufficient to float the wearer vertically at about mid-chest height in a depth of water greater than that. In this position, the wearer's center of gravity is far below the top of the water and wearer is quite stable, even when receiving a weight (such as a child jumping into the water) in outstretched hands, and his or her hair is kept dry.

To keep the wearer head up and generally perpendicular to the plane of the water, it is important that the buoyancy material be symmetrically distributed left to right about the wearer's midsagittal plane (i.e., the vertical plane dividing a body into symmetrical right and left halves). Whereas the buoyancy material must be asymmetrically distributed about his or her coronal plane (i.e., the vertical plane at right angles to a sagittal plane dividing the body into anterior and posterior portions) as the user's center of gravity is not on centerline but offset towards the wearer's posterior. A proper distribution of buoyancy material is achieved when the buoyancy material is provided as a uniform layer across front and rear sections 14, 16, rear section 16 being fitted over the buttocks and slightly larger than front section 14.

In a preferred embodiment from the standpoint of comfort, front and rear sections 14, 16 have inner and outer panels 32, 34, respectively, made of nylon or the like. Panels 32, 34 are stitched or otherwise joined at spaced intervals to form a plurality of vertical pockets, including a center pocket 36 that extends from the waist through crotch 24 in both front and rear sections 14, 16, flanked by a right pocket 38 and left pocket 40. Each of pockets 36, 38 and 40 is filled with a correspondingly shaped pad 42 of buoyancy material.

Suitable buoyancy materials for use as pad 42 include foamed polyvinyl chloride and other closed cell foamed materials or the like. One such material approved by the U.S. Coast Guard for floatation devices is sold in sheets ¾ inch thick by Uniroyal Plastic Company of Mishiawaka, Ind. under the trademark ENSOLITE® MKC with a buoyancy of 56 pounds per cubic foot.

Figure 4:
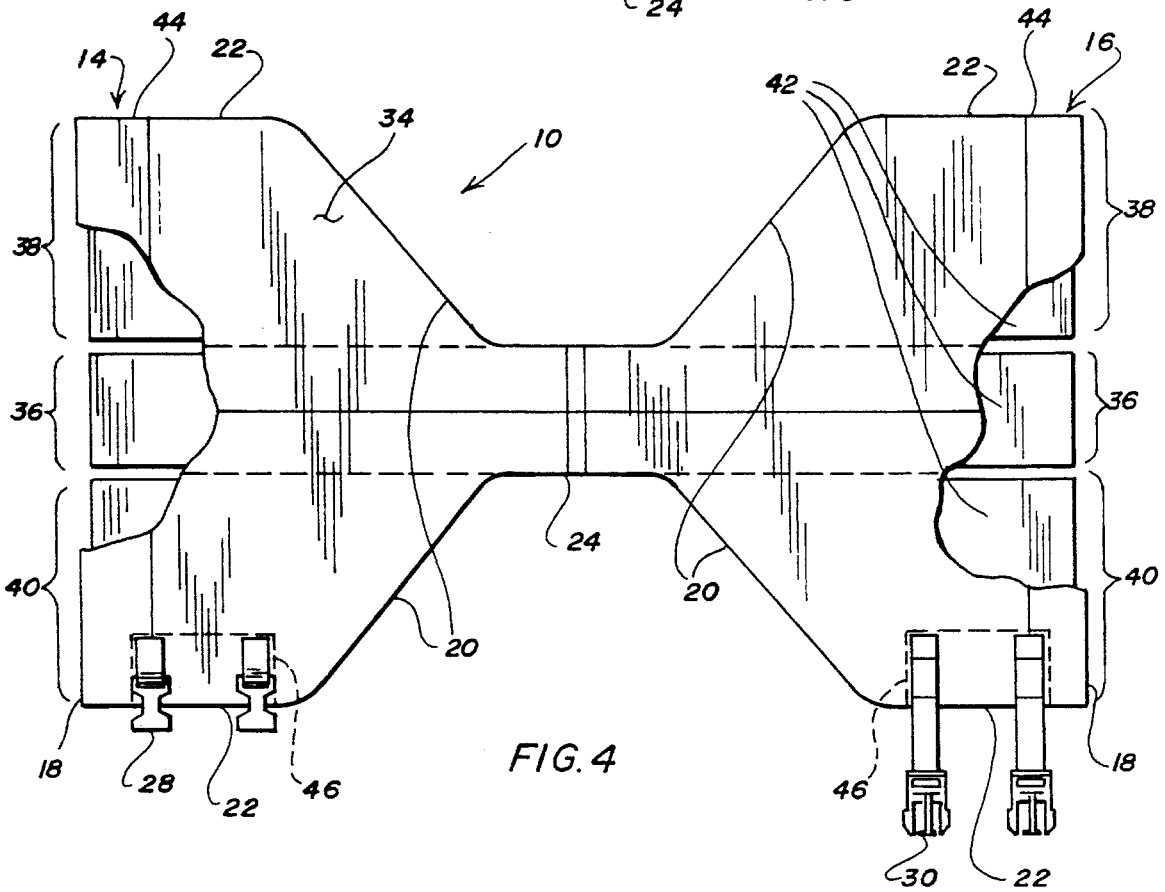
FIG. 4 is a plan view of the device with the buckles and the seam opposite the buckles open.

Device 10 is intended for adult use and is preferably provided in four or five sizes (e.g., small 90–120 lbs., medium 120–150 lbs., large 150–180 lbs., X-large 180–210 lbs. and XX-large 210–240 lbs.) to fit the dimensions and weight of the wearer. To minimize fabric waste, front and rear sections 14, 16 of both inner and outer panels 32, 34 are preferably cut in two parts and seamed down the middle and in the crotch. For appearance (FIG. 4), top edge 18 of front and rear sections 14, 16 may be provided with an integral seamed-on band 44. Strips 46 of reinforcing may be sewed on outer panel 34 of front and rear sections 14, 16 and buckles 26 attached as by stitching. After inner and outer panels 32, 34 are formed, they are joined around the bottom and releasable side edges, turned right side out and two vertical lines of stitching applied, forming pockets 36, 38 and 40. The side edges of front and rear sections 14, 16 opposite buckles 26 are closed as with a line of stitches. Pads 42 are inserted into pockets 36, 38 and 40 and the top edge about the waist closed as with a line of stitches.

In use, the wearer simply steps into device 10, pulls it up and snaps buckles 26 closed. Provisioned with device 10, a wearer will float head up, feet down, at mid-chest height in deep water with his or her hands free. An important part of device 10 is pad 42 in center pocket 36 running from the waist to the crotch in front and rear sections 14, 16 and pushing up on the user's bottom. The pad in center pocket 36 keeps the wearer from having the sense that he or she is dangling from the float as with a ski belt, lending stability to the device. After the user has finished in the water, he or she unsnaps buckles 26 and steps out of the device, attired in his or her swim suit, unencumbered to sit, bend over, etc.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A recreational floatation device for wear by a person on his or her lower torso over a swimming suit, said device fitting over the wearer's stomach, buttocks and hips and fitting relatively snugly around his or her hips and around the tops of his or her legs, said device having front and rear sections, each section having top, bottom and side edges, said top edge rising to about the level of the wearer's diaphragm, said sections joined along the side edges, at least one of which side edges being releasable to allow the wearer to put on and take off the device, said sections narrowing along the bottom edge and joined to form a crotch, said front and rear sections having inner and outer panels that are attached at spaced intervals to form a plurality of pockets, a center one of which extends from the waist through the crotch in both the front and rear sections, each of said pockets filled with a pad of floatation material, said floatation material provided in an amount sufficient to float the wearer at about mid-chest height.

2. The device of claim 1 wherein the floatation material is a closed cell foam.

3. The device of claim 2 wherein the releasable side edges are closed with one or more side release buckles.

4. The device of claim 3 wherein the center pocket is flanked by right and left pockets and each pad of floatation material is of corresponding shape.

5. The device of claim 4 wherein the front and rear sections of both inner and outer panels are formed from two symmetrical parts and seamed together.

* * * * *